US005823084A

United States Patent [19]

Ramey

[11] Patent Number: 5,823,084

[45] Date of Patent: Oct. 20, 1998

[54] TOOL FOR STRAIGHT LINE AND SQUARE EDGE CUTTING OF A BOARD

[76] Inventor: Lester L. Ramey, P.O. Box 520, Clayton, Ga. 30525

[21] Appl. No.: 811,133

[22] Filed: Mar. 3, 1997

Related U.S. Application Data

[63] Continuation of Ser. No. 626,821, Apr. 3, 1996, abandoned, which is a continuation of Ser. No. 91,759, Jul. 14, 1993, abandoned.

[51] Int. Cl.[6] ..... B27B 27/02

[52] U.S. Cl. ..... 83/415; 83/435.11; 83/442; 83/464; 83/477.2; 269/228

[58] Field of Search ..... 83/415, 418, 442, 83/444, 452, 460, 464, 477.2, 648, 435.11, 435.27, 437.1, 437.2; 269/201, 228, 304

[56] References Cited

U.S. PATENT DOCUMENTS

| | | | |
|---|---|---|---|
| 2,472,658 | 6/1949 | Gilbert | 269/201 X |
| 2,501,238 | 3/1950 | Sarsgard et al. | 269/228 X |
| 2,502,804 | 4/1950 | Spencer | 269/228 X |
| 3,051,204 | 8/1962 | Gaskell | 83/415 X |
| 3,587,680 | 6/1971 | Bishop | 143/157 |
| 3,872,760 | 3/1975 | Desnoyers, Jr. | 83/452 X |
| 3,986,420 | 10/1976 | Huntley et al. | 83/435.1 |
| 4,026,175 | 5/1977 | Bisey | 83/442 |
| 4,161,900 | 7/1979 | Mendelsohn | 83/409 |
| 4,164,882 | 8/1979 | Mericle | 83/435.1 X |
| 4,292,870 | 10/1981 | Mericle | 83/477.2 X |
| 4,353,536 | 10/1982 | Mazzotta | 83/477.2 X |
| 4,367,668 | 1/1983 | Jensen | 83/415 |
| 4,628,782 | 12/1986 | Park | 83/442 |
| 5,113,734 | 5/1992 | Mahler | 83/435.1 X |
| 5,159,864 | 11/1992 | Wedemeyer et al. | 83/477.2 X |
| 5,176,058 | 1/1993 | Skelly | 83/442 X |
| 5,201,863 | 4/1993 | Peot | 83/477.2 X |

*Primary Examiner*—Eugenia Jones
*Attorney, Agent, or Firm*—Jones & Askew

[57] ABSTRACT

A board straight-lining tool to be used in conjunction with a conventional circular blade table saw for the purpose of cutting a new straight and square edge longitudinal through a board. A board requiring this new edge is placed on a base of the board straight-liner, wherein a series of toggle clamps with pressure collapsing tips are toggled closed. This secures the straight-liner to the board. A separate detachable guard support is secured to the table saw with the circular blade protruding vertically through the guard support or the blade may protrude to the fence side of the guard support. The guard support keeps the board on the same plane as the table saw table and also adds a safety feature to aid in preventing the straight-liner from coming into contact with the circular blade during the cutting operation. The board is guided past the circular saw blade while keeping the straight-liner against the table saw fence. The board is severed by the saw blade thereby creating a new straight and square edge on the board.

1 Claim, 6 Drawing Sheets

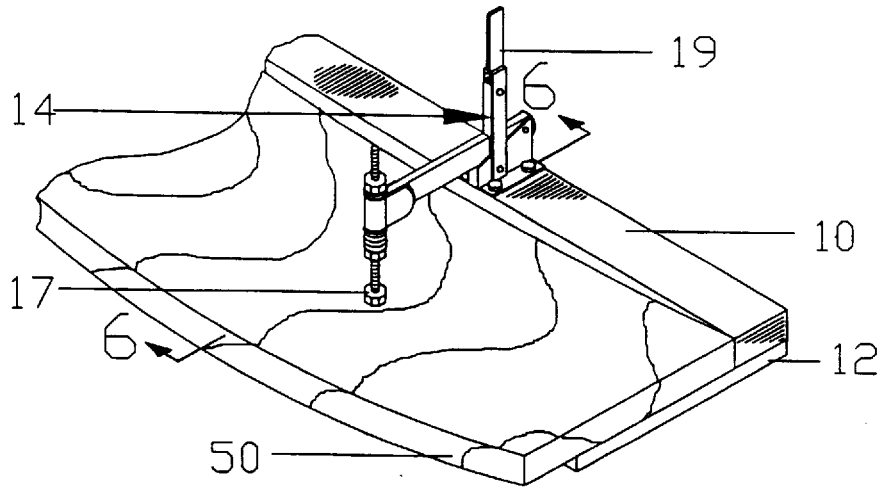
FIG 5-A
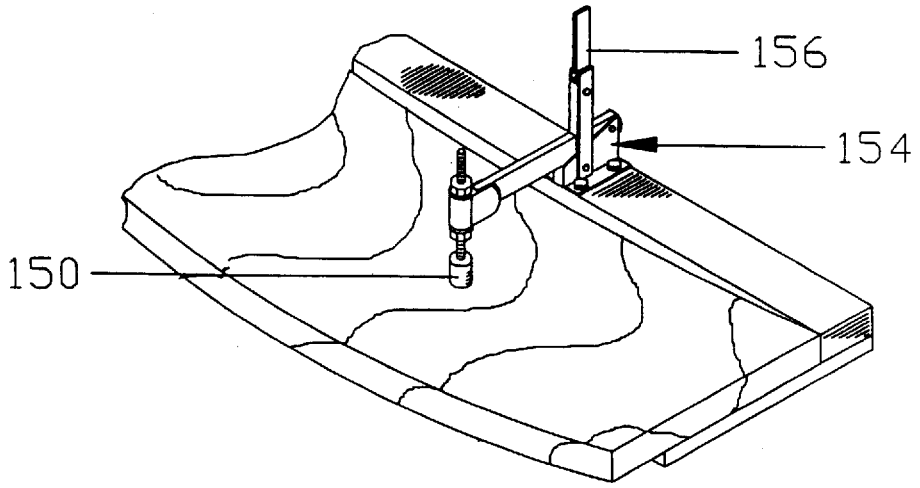
FIG 5-B

TOOL FOR STRAIGHT LINE AND SQUARE EDGE CUTTING OF A BOARD

This is a continuation of application Ser. No. 08/626,821, filed Apr. 3, 1996, abandoned, which is a continuation of Ser. No. 08/091,759, filed Jul. 14, 1993, abandoned.

BACKGROUND-FIELD OF INVENTION

This invention relates to a new and useful guide means for use with a conventional circular blade table saw to provide a straight cut longitudinal through a board.

BACKGROUND-DISCUSSION OF PRIOR ART

It is a common necessity among carpenters, manufacturers of wood moldings, cabinet makers, and other wood workers to establish a new straight and square edge on boards in a longitudinal manner that have unsquare, crooked, and/or bowed edges. The process of cutting this new edge is being referred to through-out this patent as straight-lining.

There are prior devices that could be used for the purpose of straight-lining the edge of boards. But, they were found to be either expensive motorized machines, or found to be inefficient, time consuming and cumbersome to use. This becomes apparent when more than a few boards require straight-lining.

The straight edge member in U.S. Pat. No. 3,587,680 (1971) to Bishop suggests nails to be nailed through a flange into the board to be straight-lined. To install and remove nails would be very time consuming, plus nail holes are left in the board.

U.S. Pat. No. 4,026,175 to Bisey (1977) describes a Table Saw Wood Edging Alignment Tool. This prior art reveals that only short lengths of wood could be squared. The prior art also suggests that a predetermined reference line must be penciled onto the board being squared. The pencil line is then used as a reference for setup. This process would be labor intensive and impractical for straight-lining longer boards.

U.S. Pat. No. 4,161,900 to Mendelsohn (1979) was designed for cutting straight edges on veneer sheets. It would be most difficult to align a bowed or crooked board in this fixture. An inconsistent thickness of a board would also pose a problem in securing the board into the jig. The patent further reveals T-shaped handles that are rotated to secure the material in the fixture. The time required to twist the handles to secure, straight-line, and then untwist to release the board for varying thickness of boards would be very labor intensive.

U.S. Pat. No. 4,367,668 to Jensen (1983) is dedicated to performing cuts on small wood pieces and cannot effectively be used to straight-line longer boards.

U.S. Pat. No. 4,628,782 to Park (1986) suggests threaded mechanisms including knobs that are used to secure a guide clamp to the board being cut. Turning of the suggested knobs or the T-shaped handles to secure boards, and upon straight-lining, the knobs or T-shaped handles would have to be turned in an opposite manner to release the boards this is not an efficient technique of clamping. This inefficiency would become apparent when a wood worker had more than a few boards to straight-line. Also, if boards being straight-lined were of varying thicknesses, physical labor would be increased. The Park patent also suggests an alternate-embodiment providing cam clamping members (FIG. 11 and FIG. 12) to secure the boards to the guide clamp. This process of clamping and releasing is also labor intensive and the cam would surely blemish a board having a finished surface.

OBJECTS AND ADVANTAGES

Accordingly, several objects and advantages of my invention are:

(a) to provide a vast improvement over prior art in design, construction, and efficiency of a board straight-liner for use in the woodworking industry;

(b) to provide a device of the character described whereby boards may be straight lined and adapted to be moved in a longitudinal manner against the fence and in guided relation to the blade of a conventional table saw, which performs the actual straight-line cut operation;

(c) to provide a device of the character described with economical means whereby boards may be straight-lined easily, efficiently, and accurately, including when more than a few boards are to be straight-lined;

(d) to provide a device of the character described with economical means whereby fixed or random lengths, and/or fixed or random widths, and/or fixed or random thickness of boards may be straight lined easily, efficiently, and accurately;

(e) to provide a device of the character described having special provisions allowing for quick adaptation to many different brands of circular blade table saws;

(f) to provide a device of the character described having an efficient means of detachable engagement with a board;

(g) to provide a device of the character described including a guard support for elevating the board being straight-lined to be level with the table of the conventional table saw;

(h) to provide a device of the character described having a special provision for safety.

Further objects and advantages are to provide a board straight-liner which is efficient and easy to operate, inexpensive to purchase, which is quickly adapted and installed on table saws, and which will not harm finished boards.

Still further objects and advantages will become apparent from a consideration of the ensuing description and drawings.

DESCRIPTION OF DRAWINGS

A preferred form of the present invention is illustrated in the accompanying drawings in which:

FIG. 5-A shows a perspective view of a section of a preferred straight-liner with a pressure-matic bolt retainer assembly affixed to a toggle clamp.

FIG. 5-B shows a perspective view of an alternate-embodiment toggle clamp assembly with a rubber tip assembly affixed to a straight-liner.

SUMMARY OF THE INVENTION

According to the principals of my invention, a board is clamped between a series of toggle clamps comprising of pressure collapsing tips and the clamp base of the straight-liner. The straight-liner provides a temporary straight edge to be used as a guide against the fence mounted on a circular blade table saw.

A separate guard support is secured to the table saw. The guard support has two primary functions; to keep the board on the same plane as the table saw table during the cut, and to prevent the straight-liner from coming into contact with the table saw blade during the cutting operation.

DESCRIPTION OF PREFERRED-EMBODIMENT OF THE INVENTION

Figure 1:
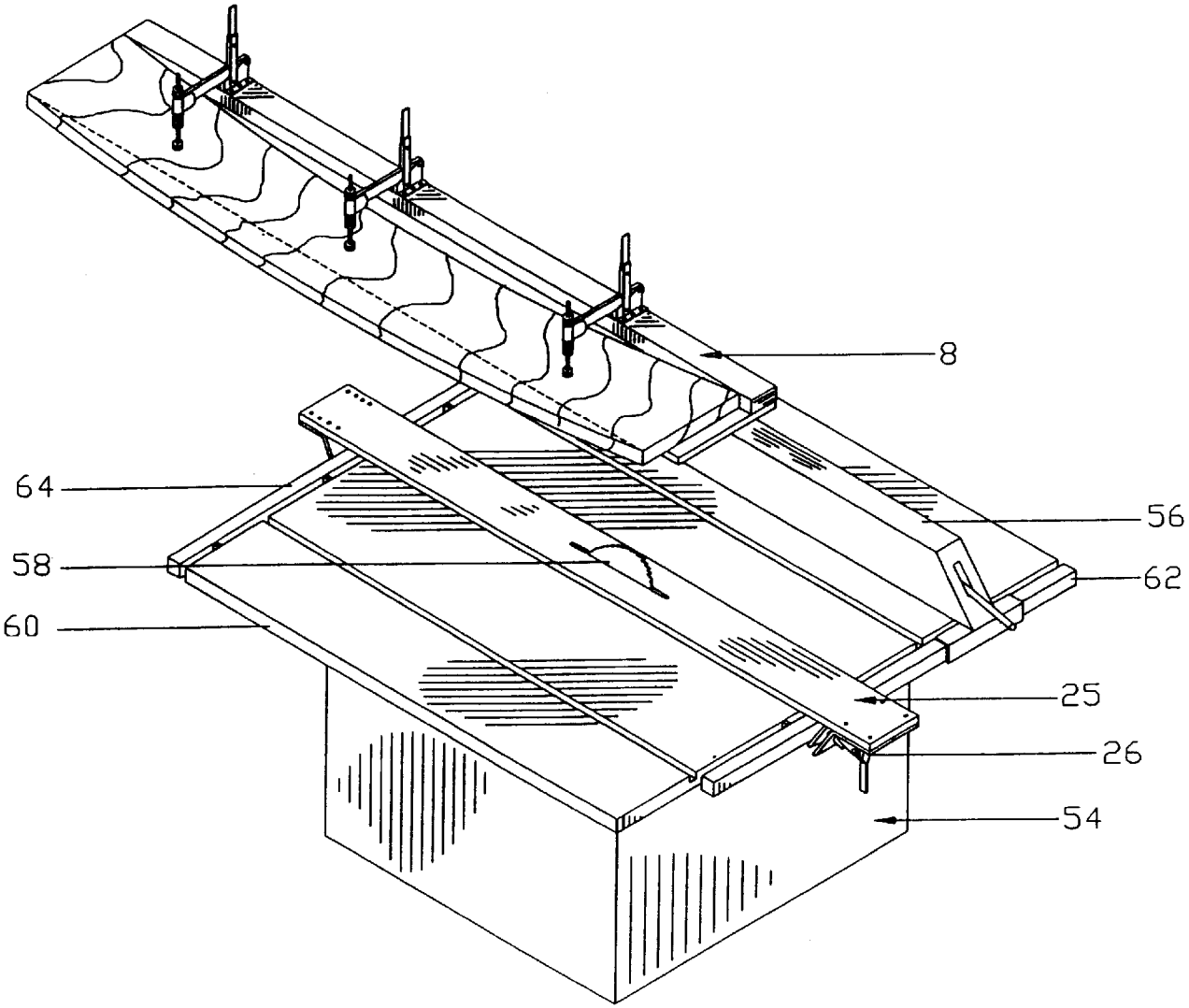
FIG. 1 shows a perspective view of the straight-liner secured to a board being straight-lined, the guard support, and a circular blade table saw.

FIG. 1 shows a perspective view of a basic version of my invention, a board straight-liner 8 and a guard support 25. Board straight-liner 8 and guard support 25 are used in conjunction with a table saw 54. Table saw 54 includes a planar table 60, a laterally movable longitudinal guide member fence 56, and a circular blade 58 in a vertical plane powered by a suitable power unit, not shown. Fence 56 on table saw 54 is generally secured to table saw 54 by clamping to a front clamp bar 62 and a rear clamp bar 64 as indicated in the drawing. Other structural details of table saw 54 are not pertinent to my invention. Guard support 25 is temporarily attached to table saw 54 by clamping to front clamp bar 62 and rear clamp bar 64 by actuating a toggle clamp 26.

Figure 2:
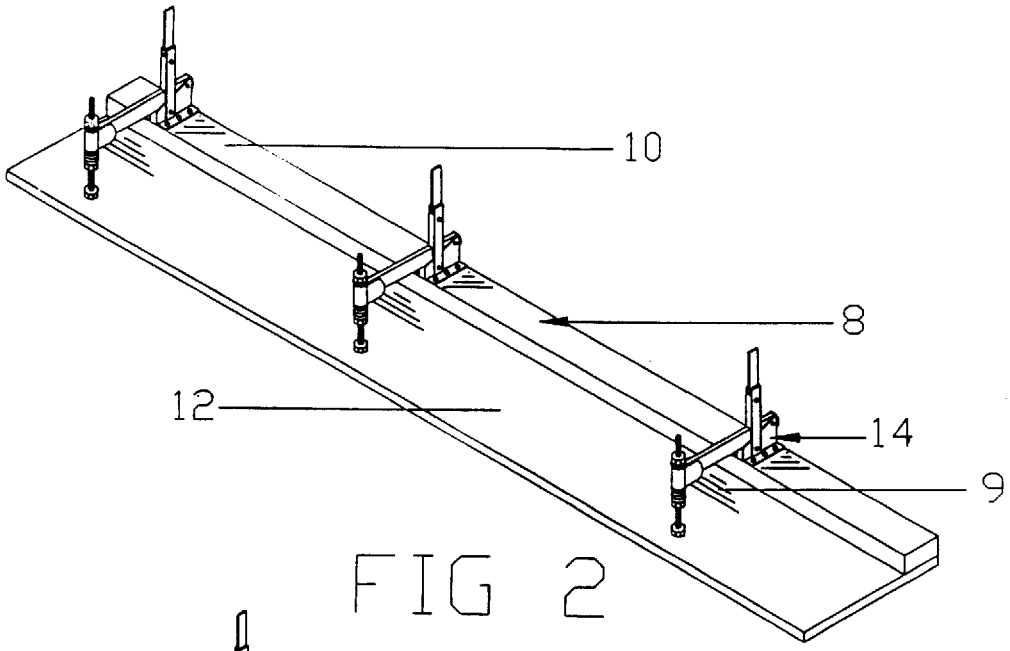
FIG. 2 shows an isometric view of the preferred straight-liner.
Figure 3:
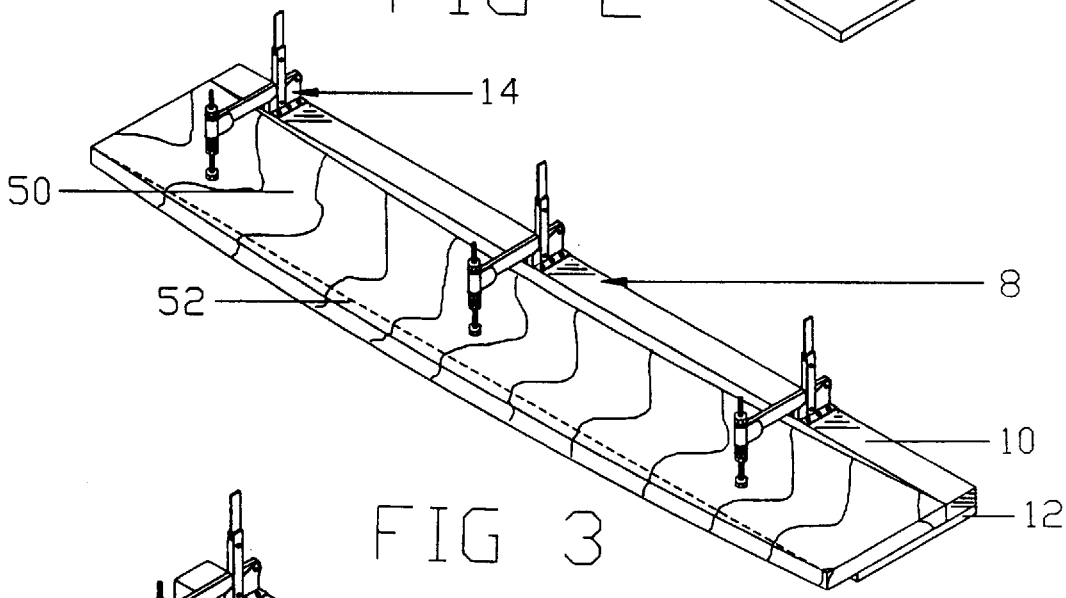
FIG. 3 shows an isometric view of the preferred straight-liner secured to a board.

FIG. 2 and FIG. 3 show perspective views of straight-liner 8. A clamp base 12 is attached to a spacer guide 10 in which a plurality of toggle clamp assembly 14 are mounted in a lateral manner. Clamp base 12 has a plurality of a indicator gage 9 located in the area near each toggle clamp assembly 14. FIG. 3 shows straight-liner 8 secured to a board 50 with a line of cut 52. Clamp base 12 is secured to spacer guide 10 by an appropriate means to secure the two parts in order they become joined. If, for instance clamp base 12 were made of plywood and spacer guide 10 were made of a 1×4 pine board, then wood glue, air driven staples, or wood screws would be appropriate means for joining. If, on the other hand clamp base 12 were made of aluminum and spacer guide 10 made of aluminum tubing, then welding would be one appropriate method for joining.

Figure 6:
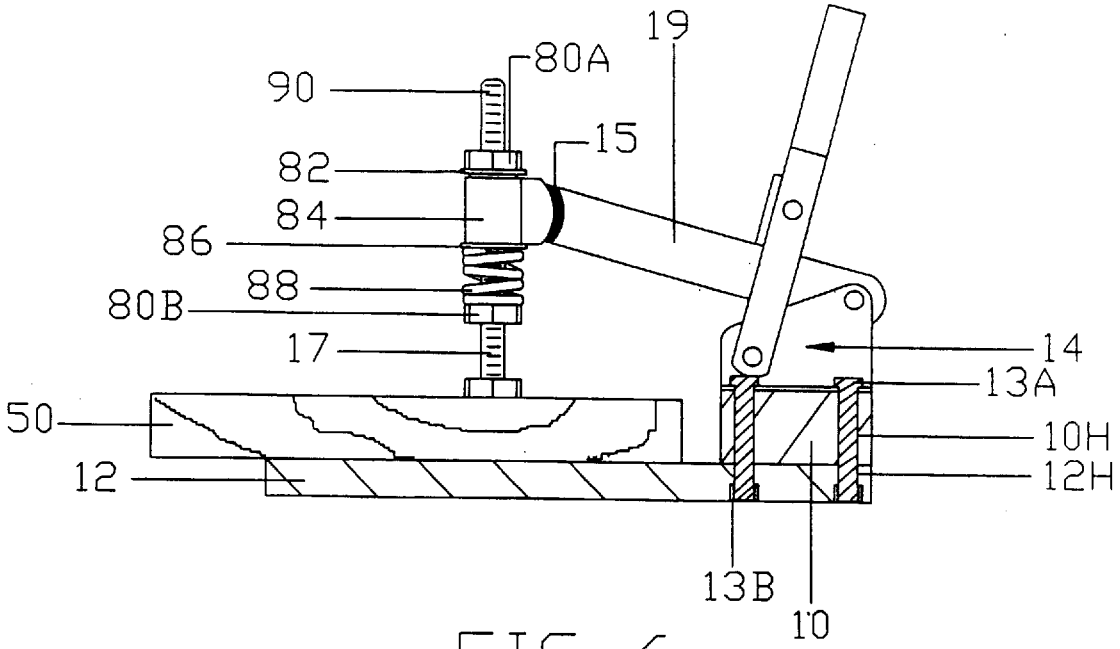
FIG. 6 shows a cross-sectional view in detail of the portion indicated by the section lines in FIG. 5A.

FIG. 5-A shows a perspective view and FIG. 6 a cross-sectional view of straight-liner 8 which comprises of clamp base 12, spacer guide 10, and toggle clamp assembly 14. Toggle clamp assembly 14 is comprised of a toggle clamp 19 and a pressure-matic bolt retainer assembly 17. Toggle clamp assembly 14 is mounted to spacer guide 10 and clamp base 12. Toggle clamp assembly 14 is fastened through a plurality of thru holes 12H in clamp base 12 and a plurality of thru holes 10H in spacer guide 10 by means of a plurality of bolts 13A and nuts 13B. Toggle clamp 19 with pressure-matic bolt retainer assembly 17 is shown in the closed position secured to board 50. Pressure-matic bolt retainer assembly 17 is secured to toggle clamp 19 by a weld 15 located on both sides of a weld bracket 84. Pressure-matic bolt retainer assembly 17 is comprised of a bolt 90 in which a nut 80A is securely tightened onto a threaded bushing 82. A bushing 86, a coil spring 88, and a nut 80B are assembled as shown.

Figure 7:
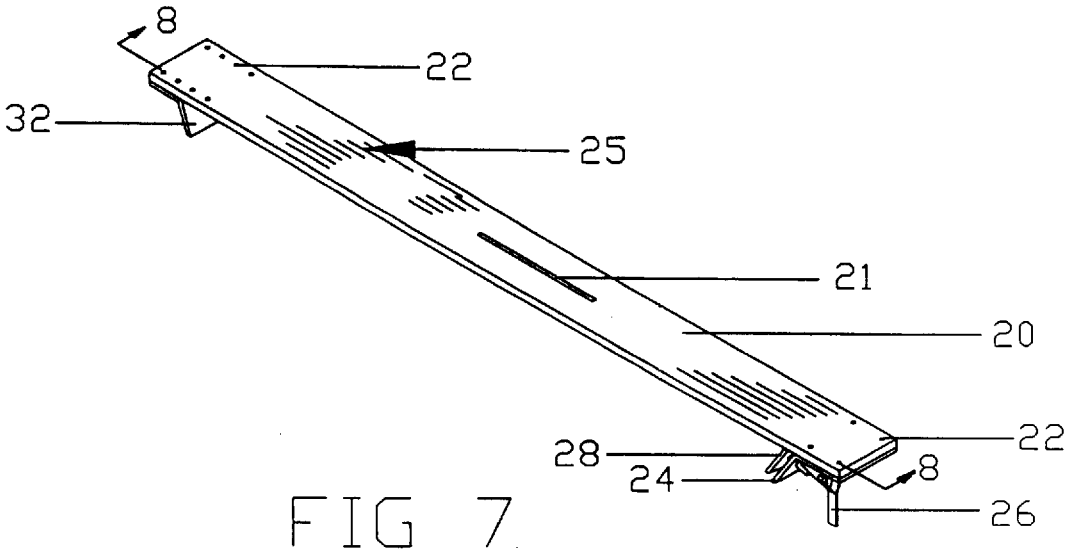
FIG. 7 shows a perspective view of the preferred guard support.
Figure 8:
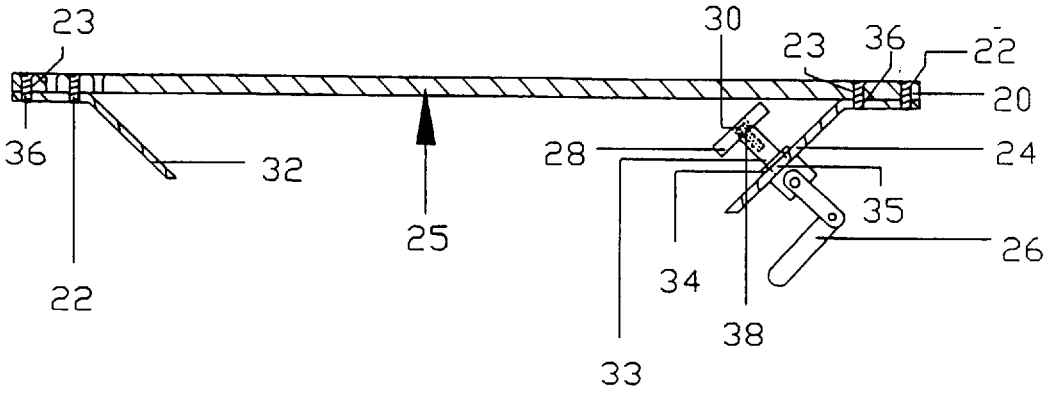
FIG. 8 shows a cross-sectional view of the preferred guard support as indicated by the section line in FIG. 7.

FIG. 7 shows a perspective view and FIG. 8 shows a cross-sectional side view of a preferred guard support 25 in which a plurality of screws 22 is used to secure a front angle 24 and a rear angle 32 to a plate 20. The drawing reveals screws 22 are mounted through a thru holes 23 into a plurality of threaded holes 36 of both front angle 24 and rear angle 32. A toggle clamp 26 is secured through a hole 35 in front angle 24 by a nut 34. A locking plate 28 is secured to a shaft 33 of toggle clamp 26 by a bolt 30 through a hole 38. Also shown is a slot 21 of predetermined length and width.

DESCRIPTION OF ALTERNATE-EMBODIMENTS OF MY INVENTION

Figure 4:
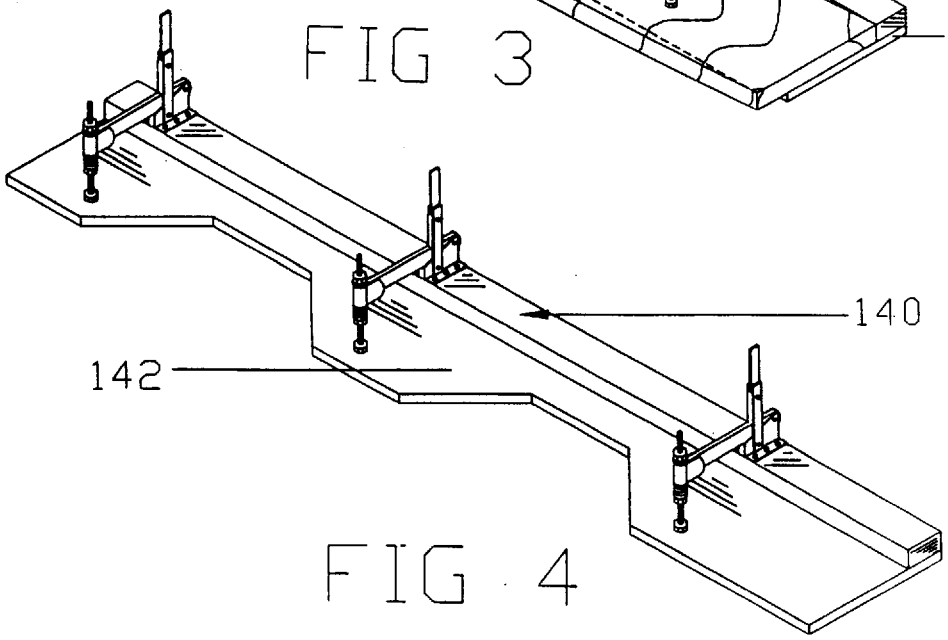
FIG. 4 shows an isometric view of an alternate-embodiment straight-liner.

FIG. 4 shows an isometric view of an alternate-embodiment straight-liner 140. A clamp base 142 having an irregular shape is the primary difference between this alternate-embodiment and the preferred embodiment. Clamp base 142 may take on many different shapes as long as the area used for clamping is flat.

FIG. 5-B shows a perspective view of an alternate-embodiment toggle clamp assembly 154 comprising of a toggle clamp 156 and a rubber spindle assembly 150.

Figure 9:
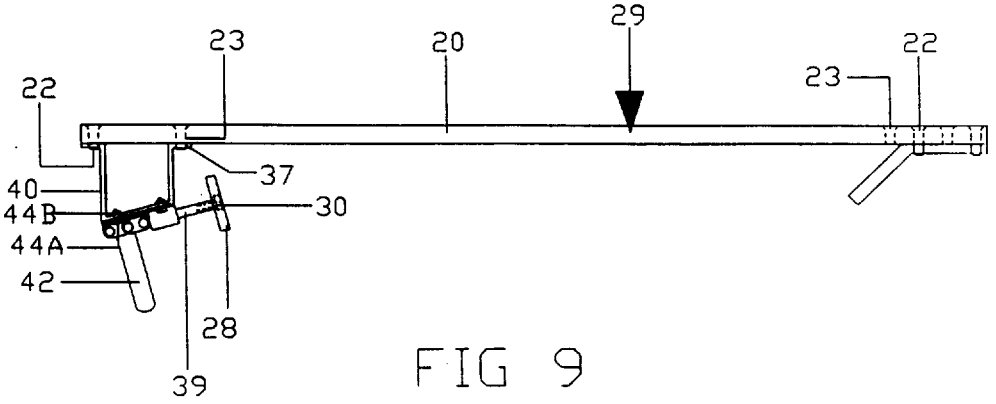
FIG. 9 shows a perspective view of an alternate-embodiment guard support.

FIG. 9 shows a perspective view of an alternate-embodiment guard support 29. A bracket 40 is used to mount a toggle clamp 42 to a predetermined angle. Locking plate 28 is secured to a shaft 39 by bolt 30. A plurality of screws 44A and nuts 44B are used to secure toggle clamp 42 to bracket 40. Bracket 40 is secured to plate 20 by screws 22 thru a plurality of holes 23 into a plurality of threaded hole 37.

Figure 10:
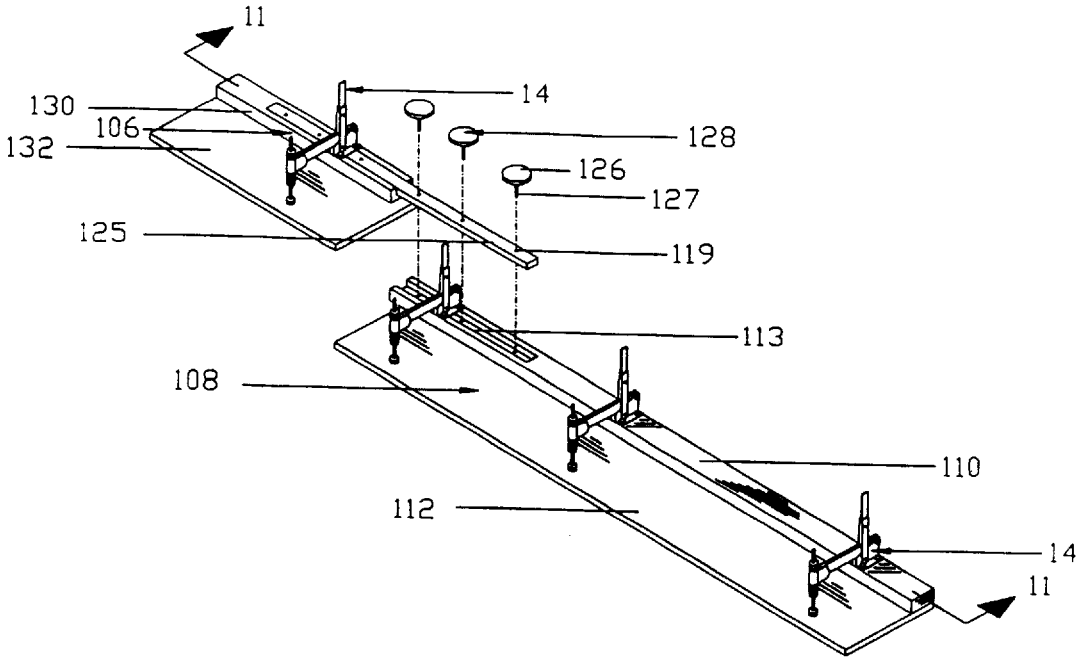
FIG. 10 shows an isometric view of an alternate-embodiment straight-liner with extension.
Figure 11:
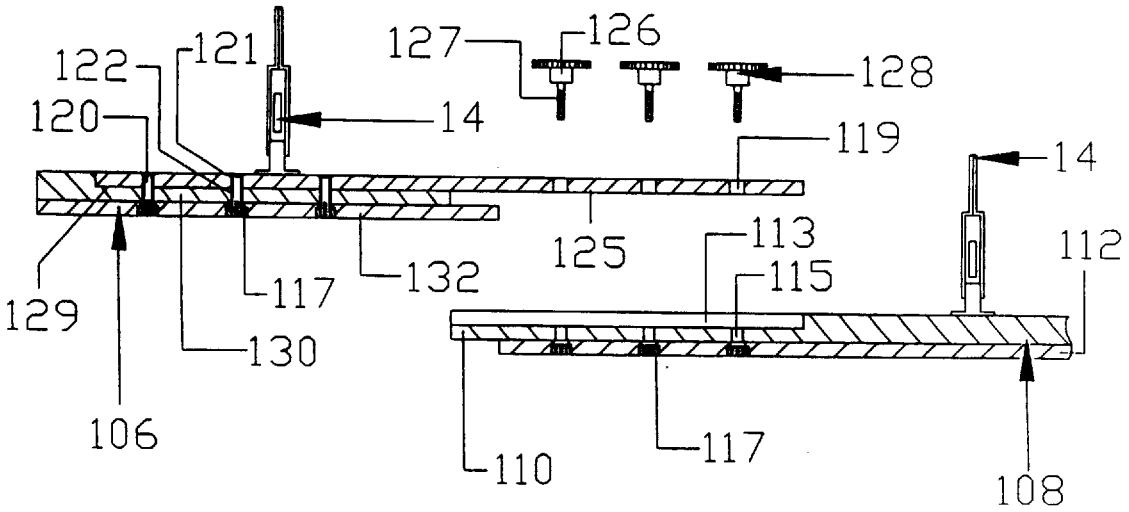
FIG. 11 shows a cross-sectional view of the alternate-embodiment straight-liner with extension as indicated by the section line in FIG. 10.

FIG. 10 shows an isometric view and FIG. 11 a cross-sectional view of an alternate-embodiment straight-liner 108 with an extension 106. Straight-liner 108 is made with a spacer guide 110 having a specified length differential from a clamp base 112. Spacer guide 110 possesses an elongated slot 113 of predetermined length and width. Straight-liner 108 possesses toggle clamp assemblies 14. Spacer guide 110 comprises of a plurality of thru holes 115 and a plurality of threaded inserts 117. Extension 106 comprises of a clamp base 132 and a spacer guide 130. Spacer guide 130 possesses a cut-out 129 in which to accommodate an elongated bar 125. Bar 125 of predetermined length and width is secured to extension 106 by a plurality of screw 120 mounted through a plurality of thru holes 121 and 122 into threaded inserts 117. Extension 106 possesses a minimum of one toggle clamp assembly 14. Spacer guide 130 has a specified length differential from clamp base 132. Bar 125 possesses a plurality of holes 119. A plurality of knob assembly 128 comprises of a handle 126 and a stud 127.

Operation of Preferred-Embodiment Invention

In operation the guard support 25 shown in FIG. 3 is first affixed to table saw 54 with the table saw circular blade 58 protruding vertically upward through slot 21 in plate 20. An option to locating the guard support with blade 58 protruding through slot 21 is to locate the guard support beside blade 58 on fence 56 side of table 60. Two primary purposes of guard support 25 are: (1) for safety, to better ensure that straight-liner 8 does not come into contact with circular blade 58, and, (2) to keep board 50 on the same plane as table saw 54. The thickness of plate 20 is the same thickness as clamp base 12 in FIG. 1. Rear angle 32 is secured in appropriate holes 23 to allow proper fit to front clamp bar 62 and rear clamp bar 64 on table saw 54 as shown in FIG. 1. The handle of straight line toggle clamp 26 is toggled to move locking plate 28 onto front clamp bar 62 and therefore secures guard support 25 to table saw 54. Due to the angles of front angle 24 and rear angle 32, and the ability to quickly relocate rear angle 32, guard support 25 will quickly adapt to most conventional table saws. This is regardless of whether front clamp bar 62 and rear clamp bar 64 are made of rectangular tubing, square tubing, angle iron, round tubing or any combination thereof.

Next, one end of straight-liner 8 is positioned on the in-feed side of table saw 54 and the other end resting on a temporary stand, not shown. The stand assists in keeping straight-liner 8 on the same plane as table 60 which facilitates loading of board 50. Indicator gage 9 shown in FIG. 2 is used for simplifying visual alignment. It assists the woodworker in making a quick judgement on the proper positioning of board 50 into straight-liner 8.

Upon board 50 being positioned into straight-liner 8, toggle clamp assemblies 14 are toggled to secure straight-liner 8 to board 50. A component part of toggle clamp assembly 14, the pressure-matic bolt retainer assembly 17 is one of the major components of this invention. By design of pressure-matic bolt assembly 17, it allows for clamping of a wide range of varying thicknesses of boards without making adjustments to the assembly, while still providing adequate clamping pressure.

Board 50 is moved laterally and positioned accordingly upon determining a preferred visual approximation location of line of cut 52. Table saw fence 56 is moved to contact the edge of board straight-liner 8 and locked in place by applicable means. Then, with table saw 54 operational, board 50 is guided through circular blade 58 keeping straight-liner 8 against table saw fence 56. As straight-liner 8 is guided through table saw 56, a new straight and square edge is produced on board 50. An out-feed table, not shown, for table saw 54 is preferred to support board 50 and straight-liner 8. The toggle clamp assemblies 14 are then released and board 50 removed. Straight-liner 8 is then repositioned to the in-feed side of table saw 54 where the procedure is repeated for the next board.

Operation of Alternate-Embodiment Invention

Operation of the alternate-embodiment of FIG. 4 is the same as outlined for the preferred embodiment.

Operation of the alternate-embodiment of FIG. 5-B is the same as outlined for the preferred embodiment of FIG. 5-A.

Operation of FIG. 9 alternate-embodiment guard support 29 is secured to table saw 54 by rear angle 32 and locking plate 28, which clamps to clamp bar 62 and rear clamp bar 64. Actual clamping is performed by actuating toggle clamp 42.

In operation straight-liner 108 and extension 106 are temporarily attached for purpose of extending the overall length. The option of extension could keep a woodworker from having to purchase two lengths of my invention. If, for instance the length of straight-liner 108 were 12 feet, but when connected with extension 106 the overall length could be 16 feet. This would allow a wood worker using straight-liner 108 to straight-line shorter lengths of boards without extension 106 and longer lengths of boards with extension 106.

Assembly of extension 106 to straight-liner 108 is by sliding bar 125 into slot 113 of straight-liner 108. Bar 125 passes under toggle clamp assembly 14 on straight-liner 108. Extension 106 is slid into straight-liner 108 until spacer guide 110 and spacer guide 130 contact, and clamp base 112 and clamp base contact. Knob assemblies 128 go through bar 125 and into threaded inserts 117, which when tightened secure extension 106 to straight-liner 108.

SUMMARY, RAMIFICATIONS, AND SCOPE

Thus the reader will see this invention, a board Straight-Liner does provide a cost effective, efficient and accurate means of straight-lining boards of varying widths and thicknesses.

While my above description contains many specificities, these should not be construed as limitations on the scope of the invention, but rather as an exemplification of one preferred embodiment thereof. Many other variations are possible. Examples are as follows:

- the straight-liner may possess a handle at one end, or near each end. This would enable better control and handling of the straight-liner moving back and forth across a table saw.
- the pressure-matic bolt retainer assemblies may be replaced with other pressure-matic type securing devices. Devices constructed with rubber or the like would fall into this category.
- the toggle clamps shown in the drawings are just some of many that work. There are many other variations of toggle clamps that work equally well.
- the alternate-embodiment straight-liner with extension design is just one of a number of designs. Many variations of adapting an extension are possible.
- many variations of shapes of the straight-liner clamp base are possible.
- the spacer guide may be eliminated, or made into sections or blocks.
- the straight-liner may posess a stop on the operator held end to position the board against. This would ensure the board could not slide backwards during the cutting operation.

Accordingly, the scope of the invention should be determined not by the embodiment(s) illustrated, but by the appended claims and their legal equivalents.

I claim:

1. A tool to be used in conjunction with a conventional table saw so as to cut a straight or a square edge on a wooden board, said table saw including a flat table, a cutting element extending vertically upwardly driven by an electric motor, front and rear clamp bars, and a laterally movable fence, said wooden board secured to said tool such that said wooden board and said tool are guided longitudinally along said laterally movable fence past the cutting element, said tool comprising:

an elongated clamp base having a predetermined thickness and a straight longitudinal edge which, in use, is positioned parallel to said fence of said table saw, said clamp base having a spacer guide attached thereto, said spacer guide having a slot therein;

at least one toggle clamp assembly affixed to said elongated clamp base, said toggle clamp assembly comprising an arm that extends over said clamp base and a bolt assembly operatively connected to said toggle clamp arm for securing said wooden board in position; and an extension base having a bar attached thereto, said bar being received by said slot in said spacer guide for attaching said extension base to said clamp base, and at least one toggle clamp assembly affixed to said extension base, said extension base toggle clamp assembly comprising an arm that extends over said extension base and a bolt assembly operatively connected to said arm of said extension base toggle clamp assembly for securing said wooden board in position.

* * * * *